US012320360B2

(12) United States Patent
Lin

(10) Patent No.: US 12,320,360 B2
(45) Date of Patent: Jun. 3, 2025

(54) SILENT HIGH-SPEED FAN

(71) Applicant: Shenzhen Hengmeite Technology Co., Ltd, Shenzhen (CN)

(72) Inventor: Yongcai Lin, Huilai (CN)

(73) Assignee: Shenzhen Hengmeite Technology Co., Ltd, Shenzhen (CN)

( * ) Notice: Subject to any disclaimer, the term of this patent is extended or adjusted under 35 U.S.C. 154(b) by 0 days.

(21) Appl. No.: 18/806,058

(22) Filed: Aug. 15, 2024

(65) Prior Publication Data

US 2024/0401604 A1 Dec. 5, 2024

(51) Int. Cl.

| | |
|---|---|
| ***F04D 19/00*** | (2006.01) |
| ***F04D 25/06*** | (2006.01) |
| ***F04D 25/08*** | (2006.01) |
| ***F04D 29/38*** | (2006.01) |

(52) U.S. Cl.

CPC ..... *F04D 19/002* (2013.01); *F04D 25/0673* (2013.01); *F04D 25/08* (2013.01); *F04D 29/384* (2013.01)

(58) Field of Classification Search

CPC ... F04D 19/002; F04D 19/0673; F04D 19/084

See application file for complete search history.

(56) References Cited

U.S. PATENT DOCUMENTS

| | | | |
|---|---|---|---|
| 2008/0107528 | A1 | 5/2008 | Tsuji et al. |
| 2020/0248714 | A1 | 8/2020 | Santolucito et al. |
| 2023/0019804 | A1 | 1/2023 | Santolucito et al. |

*Primary Examiner* — Brian O Peters

(74) *Attorney, Agent, or Firm* — Hemisphere Law, PLLC; Zhigang Ma

(57) ABSTRACT

The present disclosure discloses a silent high-speed fan, including a shell; an air duct is formed on the shell; an air inlet and an air outlet are respectively provided at two ends of the air duct; a boosting mechanism is arranged in the air duct; a rectification mechanism is arranged at the air outlet; the rectification mechanism includes a necking hood that covers the air outlet and a rectification blade group composed of a plurality of rectification blades arranged coaxially on an inner side of the necking hood in an annular array. The present disclosure controls the details in an air flow stroke, so that the turbulence is eliminated step by step, and the turbulence is eliminated at the source, to achieve an effect of silently blowing air at a high speed.

10 Claims, 8 Drawing Sheets

SILENT HIGH-SPEED FAN

TECHNICAL FIELD

The present disclosure relates to the technical field of fans, and in particular, to a silent high-speed fan.

BACKGROUND

When people go out or engage in outdoor activities in the hot summer, there may be no air conditioner. To facilitate cooling at any time, portable fans have emerged, which enjoy great popularity because they are convenient to carry and can be used at any time.

However, due to a small size of the portable fans, electric devices provided for the portables fan can only use low power. Therefore, the conventional portable fans may not be designed to have high wind strength, so that the portable fans have poor air blowing and cooling effects. Although some manufacturers have applied a structure of a traditional booster fan to this type of small-size portable fans to increase the wind speed to improve the cooling effect, such as Chinese patent (No. CN217029352U), this does not consider the problem of a turbulent air flow. As a result, the portable fan is noisy during operation. This severely affects the customer experience and is not conductive to popularization and application of a product.

SUMMARY

The present disclosure aims to provide a silent high-speed fan. By controlling the details in an air flow stroke, the turbulence is eliminated step by step, so that the turbulence is eliminated at the source, so as to achieve an effect of silently blowing air at a high speed, thus solving the problems in the background section.

To achieve the above objectives, the present disclosure provides the following technical solutions: A silent high-speed fan includes a shell; an air duct is formed on the shell; an air inlet and an air outlet are respectively provided at two ends of the air duct; a boosting mechanism is arranged in the air duct; the boosting mechanism drives air located at the air inlet to flow through the air duct and then be blown out from the air outlet at a high speed; a rectification mechanism is arranged at the air outlet; the rectification mechanism includes a necking hood that covers the air outlet and a rectification blade group composed of a plurality of rectification blades arranged coaxially on an inner side of the necking hood in an annular array; two ends of the necking hood are both provided with openings; an inner diameter of the necking hood decreases radially from one end facing the air duct to one end away from the air duct; the rectification blades comprise air outlet rectification plates and wind concentration rectification plates; the air outlet rectification plates are arranged on one side close to the air duct; the wind concentration rectification plates are connected to one ends of the air outlet rectification plates close to an inner wall of the necking hood and extend towards one side edge of the necking hood away from the air duct; side edges of the wind concentration rectification plates close to an inner wall surface of the necking hood are tightly connected to the inner wall surface of the necking hood; and the air outlet rectification plates and the wind concentration rectification plates are both parallel to a central axis of the necking hood.

Preferably, a width h of each air outlet rectification plate is not less than 3 mm.

Preferably, one side edge of each air outlet rectification plate facing the boosting mechanism is a first air-cutting edge, and the first air-cutting edge is an acute edge.

Preferably, a first accommodating chamber is connected to the middle of the rectification blade group; a digital display screen assembly is mounted inside the first accommodating chamber; and a transparent cover is arranged on an outer side of the digital display screen assembly in a covering manner.

Preferably, a first accommodating chamber is connected to the middle of the rectification blade group; a cold and hot semiconductor chip is mounted in the first accommodating chamber; a conduction cover covers one side of the first accommodating chamber away from the boosting mechanism; a through hole is provided on one side of the first accommodating chamber close to the boosting mechanism; a heat dissipation assembly is arranged on one side of the through hole facing the boosting mechanism; a cooling end of the cold and hot semiconductor chip is connected to the conduction cover in a thermal conduction manner; and a heating end of the cold and hot semiconductor chip is connected to the heat dissipation assembly in a thermal conduction manner.

Preferably, the boosting mechanism includes an air-driving blade assembly and an air-cutting blade group composed of a plurality of air-cutting blades arranged coaxially on one side of the air-driving blade assembly facing the rectification mechanism in an annular array; the air-driving blade assembly includes a plurality of air-driving blades arranged around a circumferential direction of the air-driving blade assembly; surfaces of the air-cutting blades facing an outer side of the air outlet is a windward surface; surfaces of sides of the air-driving blades facing the air-cutting blades are air-driving surfaces; in a rotating process of the air-driving blade assembly, in a same radial region, a curved surface where the windward surfaces are located and a curved surface where the air-driving surfaces are located are intersected; and an angle between the windward surfaces and the air-driving surfaces is $\theta 1<90°$.

Preferably, an angle $\theta 2$ between each windward surface and a central axis of the air-driving blade assembly satisfies: $30°<\theta 2<60°$.

Preferably, one side edge of each air-cutting blade facing the air-driving blade assembly is a second air-cutting edge, and the second air-cutting edge is an acute edge.

Preferably, the shell includes a front shell and a rear shell which are mutually covered and connected; after the front shell and the rear shell are covered and connected, the air duct is formed at an upper end, and a second accommodating chamber is formed at a lower end; a circuit board assembly and a battery are arranged in the second accommodating chamber; the circuit board assembly and the battery are electrically connected; an air inlet cover covers the air inlet of the air duct; the circuit board assembly is electrically connected with a control button and a USB interface; and the control button and the USB interface are both arranged in through holes preset in the shell and extend out from the through holes.

Preferably, a hang hole is provided at a corner of a lower end of the shell.

Compared with the prior art, the present disclosure has the beneficial effects below:

According to the present disclosure, the boosting mechanism achieves boosting and speeding up on an air flow for the first time; the rectification mechanism dredges a high-speed air flow to intensively blow out the air flow in a direction parallel to the axis of the necking hood as much as possible, so that the air flow utilization rate is increased, and secondary boosting and speeding up are achieved, which greatly improves the air speed and the air supply distance; furthermore, in an air flow stroke, by controlling the details, such as the first air-cutting edge and the second air-cutting edge being set as the acute edges and the rectification blades cooperating with the necking hood, the turbulence is eliminated step by step, so that the turbulence is eliminated at the source, to achieve an effect of silently blowing air at a high speed.

Figure 1:
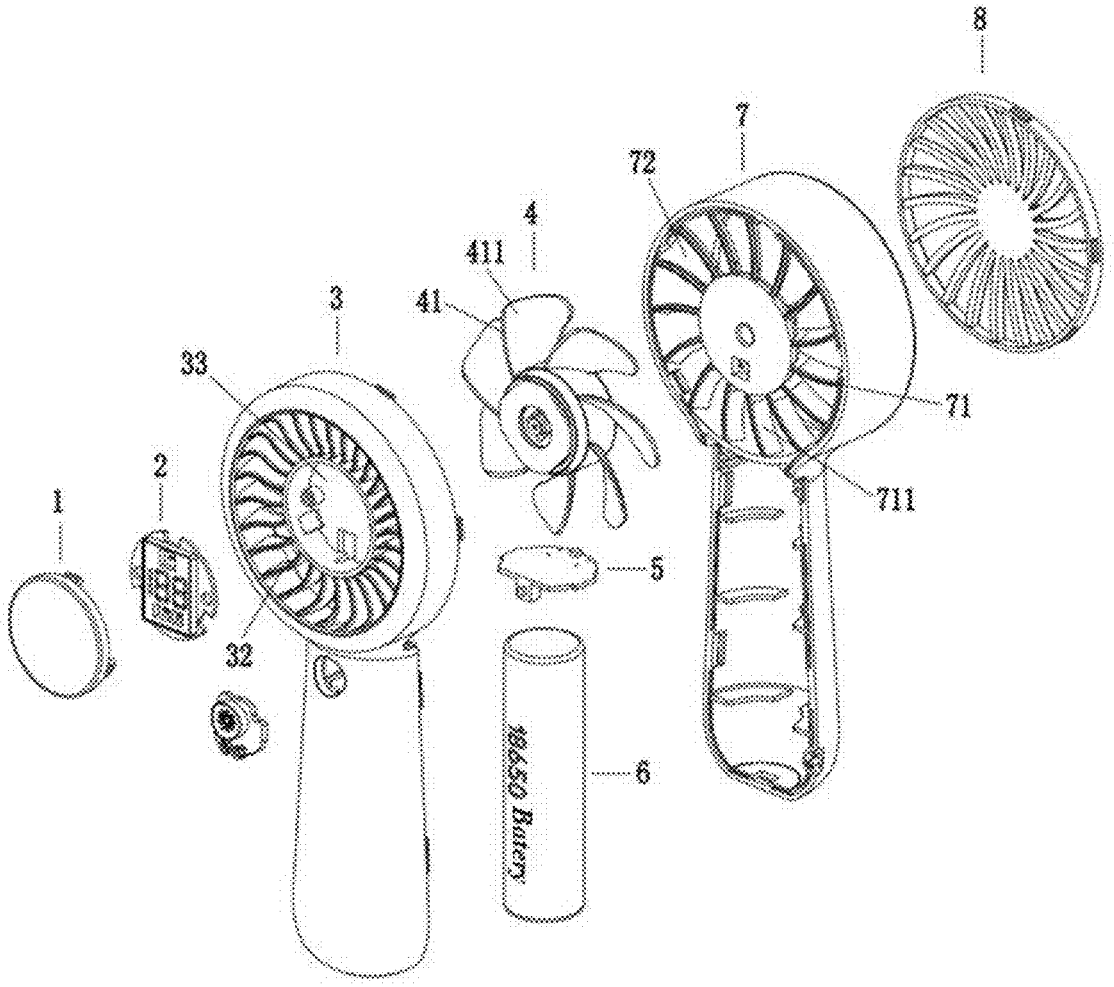
FIG. 1 is a structural exploded diagram of an embodiment of a digital display screen assembly of the present disclosure.
Figure 2:
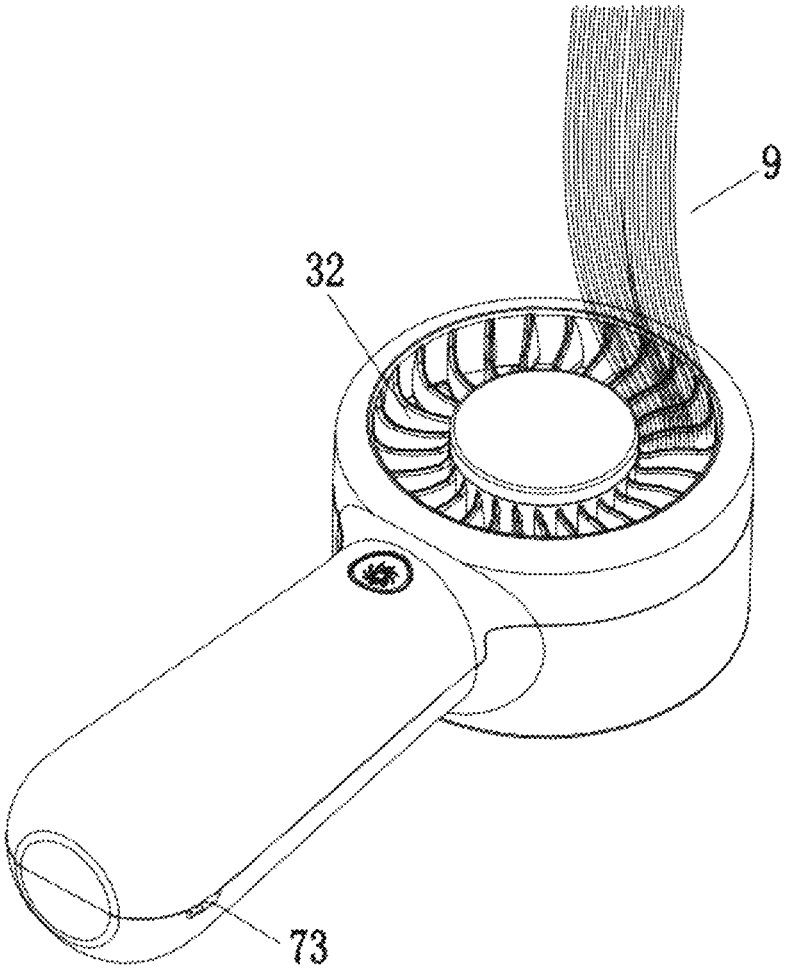
FIG. 2 is a schematic diagram of an air blowing flow of the present disclosure.

In the drawings: 1: transparent cover; 11: conduction cover; 2: digital display screen assembly; 21: cold and hot semiconductor chip; 22: heat dissipation assembly; 3: front shell; 31: necking hood; 32: rectification blade; 321: air outlet rectification plate; 322: wind concentration rectification plate; 323: first air-cutting edge; 33: first accommodating chamber; 4: air-driving blade assembly; 41: air-driving blade; 411: air-driving surface; 5: circuit board assembly; 6: storage battery; 7: rear shell; 71: air-cutting blade; 711: windward surface; 712: second air-cutting edge; 72: air duct; 73: hang hole; 8: air inlet cover; and 9: high-speed air flow.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are merely some embodiments of the present disclosure, rather than all of the embodiments. All other embodiments obtained by a person of ordinary skill in the art based on the embodiments of the present disclosure without making creative efforts shall fall within the protection scope of the present disclosure.

Referring to FIG. 1 to FIG. 8, a silent high-speed fan includes a shell; an air duct 72 is formed on the shell; an air inlet and an air outlet are respectively provided at two ends of the air duct 72; a boosting mechanism is arranged in the air duct 72; the boosting mechanism drives air located at the air inlet to flow through the air duct 72 and then be blown out from the air outlet at a high speed; a rectification mechanism is arranged at the air outlet; the rectification mechanism includes a necking hood 31 that covers the air outlet and a rectification blade group composed of a plurality of rectification blades 32 arranged coaxially on an inner side of the necking hood 31 in an annular array; two ends of the necking hood 31 are both provided with openings; an inner diameter of the necking hood 31 decreases radially from one end facing the air duct 72 to one end away from the air duct 72; the rectification blades 32 include air outlet rectification plates 321 and wind concentration rectification plates 322; the air outlet rectification plates 321 are arranged on one side close to the air duct 72; the wind concentration rectification plates 322 are connected to one ends of the air outlet rectification plates 321 close to an inner wall of the necking hood 31 and extend towards one side edge of the necking hood 31 away from the air duct 72; side edges of the wind concentration rectification plates 322 close to an inner wall surface of the necking hood 31 are tightly connected to the inner wall surface of the necking hood 31; and the air outlet rectification plates 321 and the wind concentration rectification plates 322 are both parallel to a central axis of the necking hood 31. When high-speed air blown from the boosting mechanism to the rectification mechanism reaches a start end of the necking hood 31, the high-speed air first reaches the air outlet rectification plates 321; the air outlet rectification plates 321 cuts a high-pressure air flow 9 into a plurality of high-speed air flow sheets which enter the necking hood 31; and the necking hood 31 further compresses and boosts two sides of the high-speed air flow sheets through a structure with a retracted inner wall. In this compression and boosting process, the high-speed air flow sheets may generate a turbulence effect due to sudden boosting, and the turbulence effect is mainly concentrated near an inner wall surface of the necking hood 31. Therefore, the wind concentration rectification plates 322 extend based on the air outlet rectification plates 321. The generated turbulence can be dredged and eliminated again under the sandwiching effect of two adjacent wind concentration rectification plates 322, thereby achieving an effect of effectively suppressing the turbulence, so that the structures of the high-speed air flow sheets are more stable, and higher noise can be prevented once the generation of the turbulence is suppressed. The side edges of the air outlet rectification plates 321 facing the boosting mechanism are the first air-cutting edges 323, and the first air-cutting edges 323 are acute edges. When the high-speed air flow 9 is cut by the air outlet rectification plates 321, the turbulence is reduced by setting the first air-cutting edges 323 as the acute edges, but a turbulence will be generated by a sudden increase of an air pressure during the cutting performed on the high-speed air flow 9. For this phenomenon, a width h of each air outlet rectification plate 321 is set to be not less than 3 mm. An experimental test shows that a distance greater than or equal to 3 mm can enable a small-sized portable fan to achieve a turbulence dredging and elimination effect. Therefore, by the cooperation with the structure of the above rectification mechanism, the high-speed air flow 9 can be boosted again, and generation of redundant noise is effectively avoided, thereby achieving a silence effect.

In this embodiment, the boosting mechanism includes an air-driving blade assembly 4 and an air-cutting blade group composed of a plurality of air-cutting blades 71 arranged coaxially on one side of the air-driving blade assembly 4 facing the rectification mechanism in an annular array; the air-driving blade assembly 4 includes a plurality of air-driving blades 41 arranged around a circumferential direction of the air-driving blade assembly 4; surfaces of the air-cutting blades 71 facing an outer side of the air outlet is a windward surface 711; and surfaces of sides of the air-driving blades 41 facing the air-cutting blades 71 are air-driving surfaces 411. In a rotating process of the air-driving blade assembly 4, in the same radial region, a curved surface where the windward surfaces 711 are located and a curved surface where the air-driving surfaces 411 are located are intersected; and an angle between the windward surfaces 711 and the air-driving surfaces 411 is $\theta 1<90°$. When the air-driving blade assembly 4 works, air located at the air inlet of the air duct is blown to the air-cutting blade group in an accelerated manner after being driven by the air-driving blades 41. Under the action of angular compression of the windward surfaces 711 and the air-driving surfaces 411, the air flow is boosted after being cut and compressed. During the boosting, the flowing direction of the air flow changes under the reflection action of the windward surfaces 711. To blow out the air flow reflected by the windward surfaces 711 in a direction parallel to the axis of the necking hood 31 as much as possible to increase the air flow utilization rate, an angle $\theta 2$ between each windward surface 711 and a central axis of the air-driving blade assembly 4 satisfies: $30°<\theta 2<60°$. Meanwhile, one side edge of each air-cutting blade 71 facing the air-driving blade assembly 4 is a second air-cutting edge 712, and the second air-cutting edge 712 is an acute edge. Setting the second air-cutting edge 712 as the acute edge is to make air flow cutting smooth, thereby achieving the effect of reducing the turbulence. The air flow utilization rate can be increased only if the generation of the turbulence is effectively suppressed, and the noise reduction effect is better too.

Referring to FIG. 1, a first accommodating chamber 33 is connected to the middle of the rectification blade group; a digital display screen assembly 2 is mounted inside the first accommodating chamber 33; and a transparent cover 1 is arranged on an outer side of the digital display screen assembly 2 in a covering manner. The digital display screen assembly 2 is electrically connected to a circuit board assembly 5 and can be configured to display a working mode of the fa and actual data of a battery level, thereby achieving the effect of visually monitoring a working state of the fan.

Figure 3:
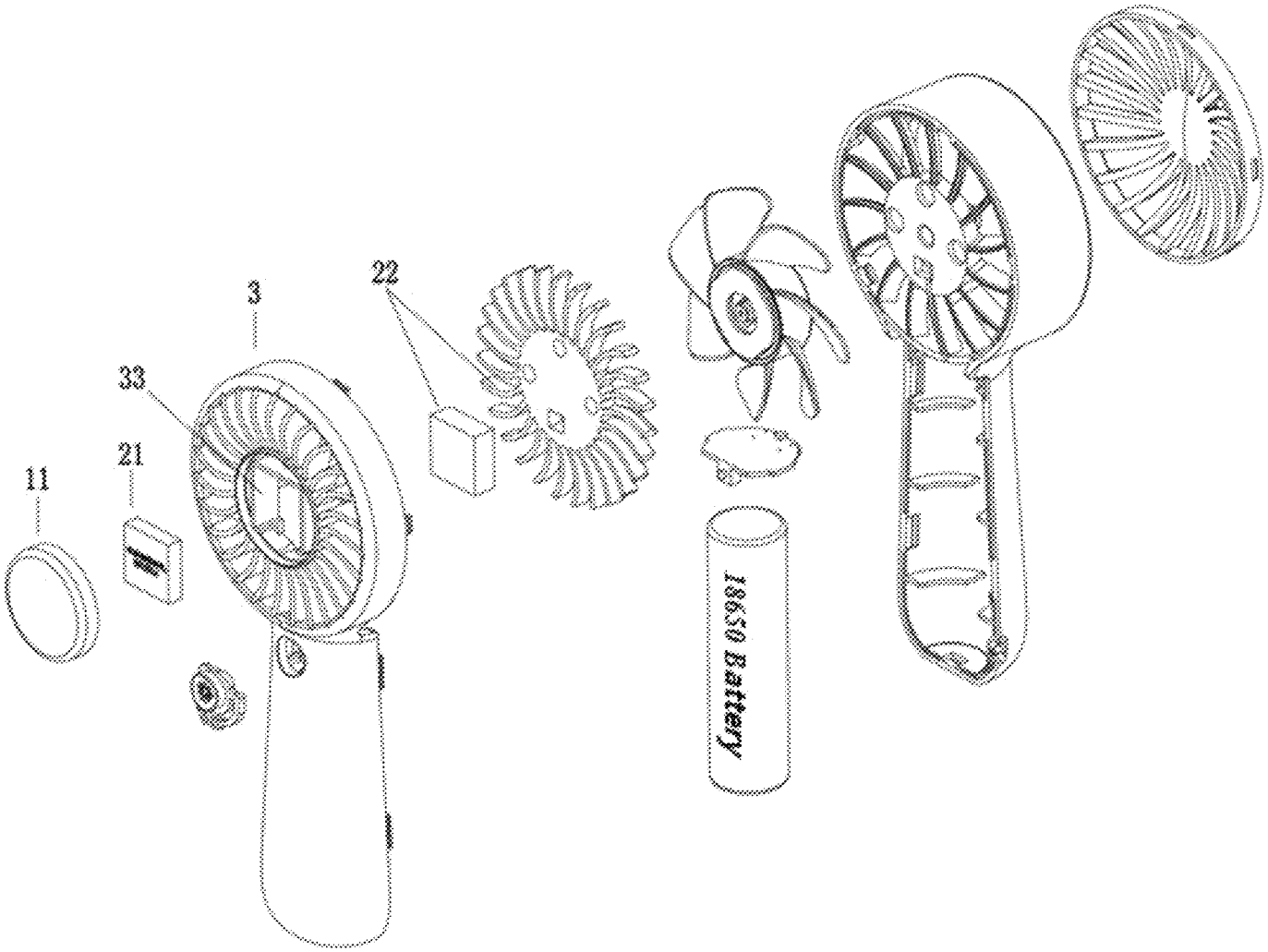
FIG. 3 is a structural exploded diagram of an embodiment of a cold and hot semiconductor chip of the present disclosure.
Figure 4:
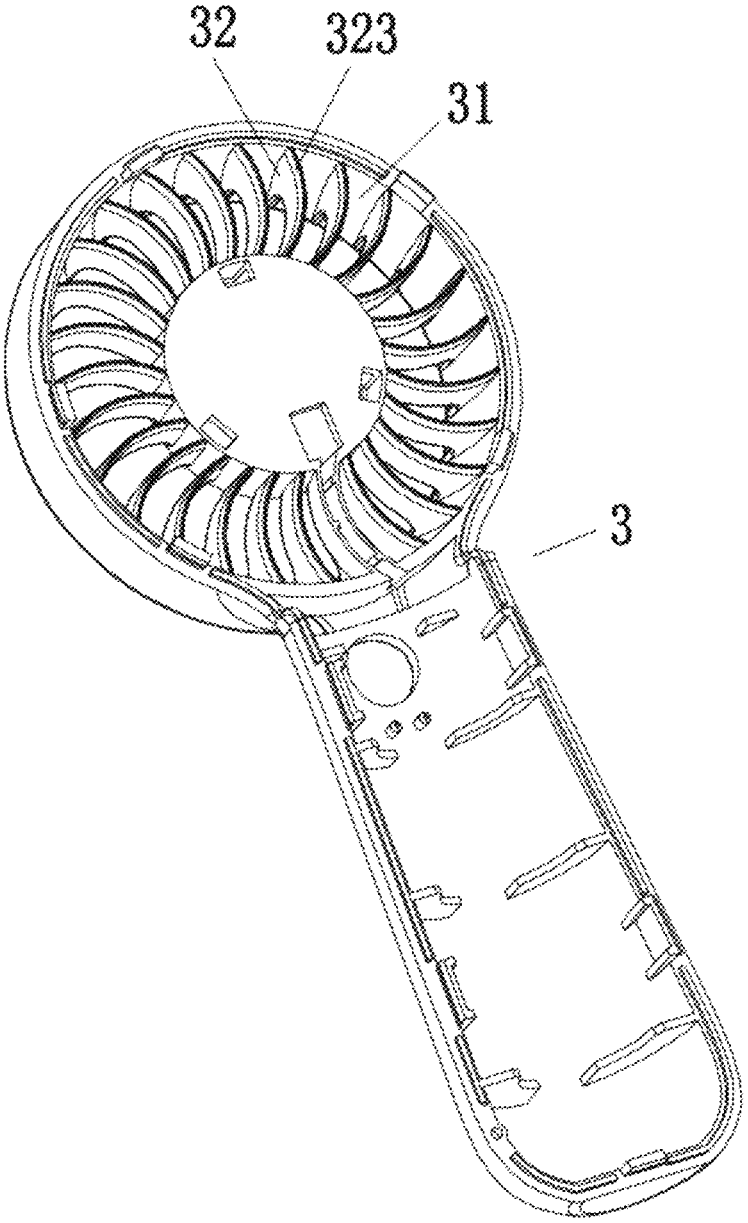
FIG. 4 is a schematic structural diagram of a front shell of the present disclosure.
Figure 5:
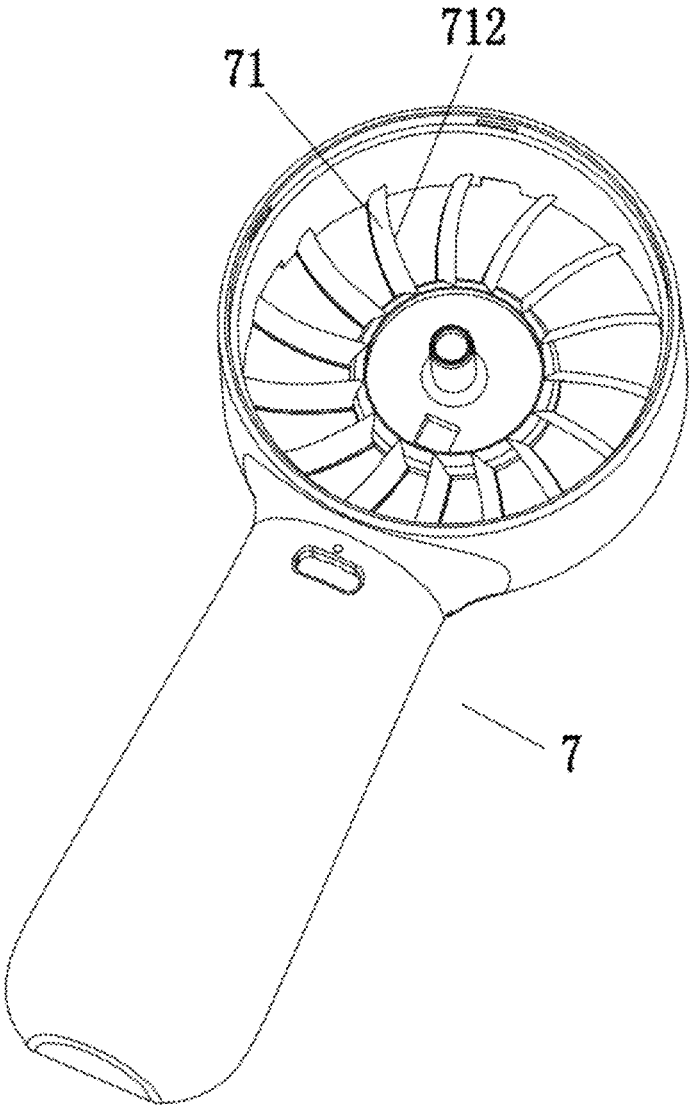
FIG. 5 is a schematic structural diagram of a rear shell of the present disclosure.
Figure 6:
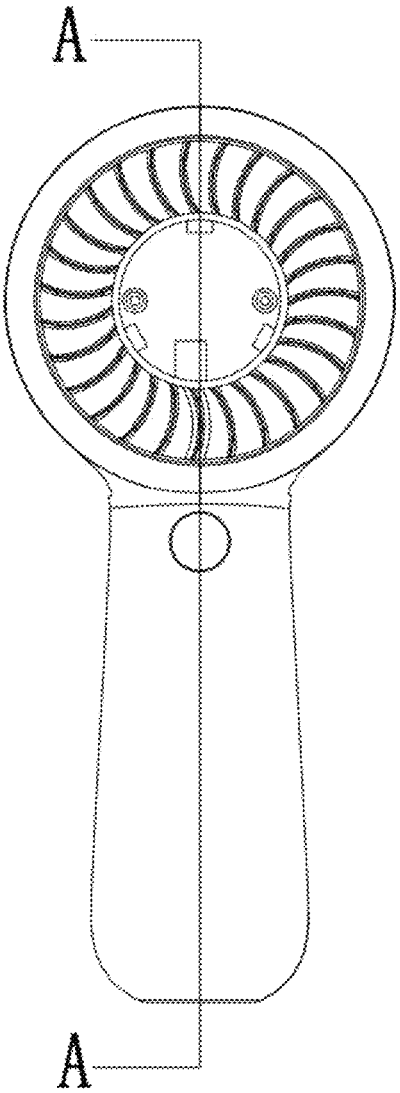
FIG. 6 is a schematic diagram of an A-A profile azimuth of a front shell of the present disclosure.
Figure 7:
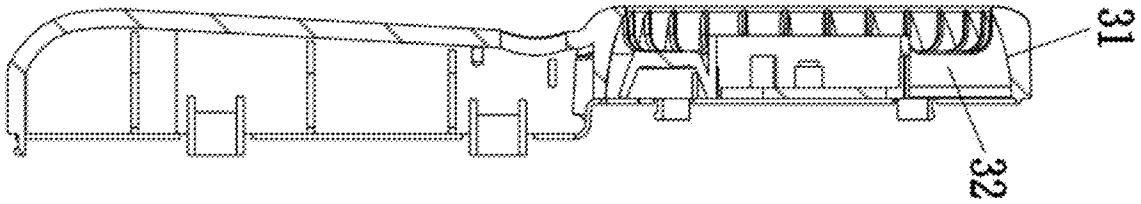
FIG. 7 is a cross-sectional view of A-A of a front shell of the present disclosure.
Figure 8:
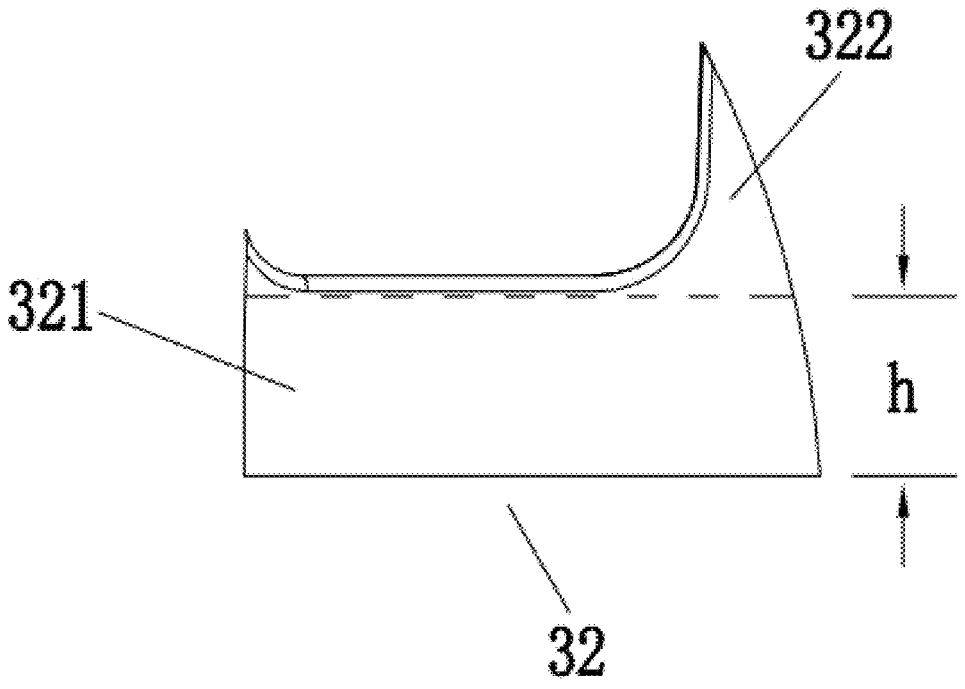
FIG. 8 is a schematic structural diagram of a rectification blade of the present disclosure.

Referring to FIG. 3, in another embodiment, a first accommodating chamber 33 is connected to the middle of the rectification blade group; a cold and hot semiconductor chip 21 is mounted in the first accommodating chamber 33; a conduction cover 11 covers one side of the first accommodating chamber 33 away from the boosting mechanism; a through hole is provided on one side of the first accommodating chamber 33 close to the boosting mechanism; a heat dissipation assembly 22 is arranged on one side of the through hole facing the boosting mechanism; a cooling end of the cold and hot semiconductor chip 21 is connected to the conduction cover 11 in a thermal conduction manner; a heating end of the cold and hot semiconductor chip 21 is connected to the heat dissipation assembly 22 in a thermal conduction manner; and the cold and hot semiconductor chip 21 is electrically connected to the circuit board assembly 5. The conduction cover 11 is an aluminum alloy housing, and the heat dissipation assembly 22 is an aluminum alloy component. To enhance the heat dissipation effect, the heat dissipation assembly 22 extends and diffuses along the contour of the rectification blades 32. When the cold and hot semiconductor chip 21 is started to work through a control button, the cold and hot semiconductor chip 21 achieves a cooling effect on the cooling end, so that the conduction cover 11 can be used for cold compress for a user after being cooled. Meanwhile, after being dissipated by the heat dissipation assembly 22, heat generated by the heating end is brought away and dissipated by wind generated by the boosting mechanism. The conduction cover 11 is concentrated, so that when the conduction cover is in contact with the skin of a user, the user obviously feels the cold compress effect due to the strong cooling effect. Due to a large heat dissipation area of the heat dissipation assembly 22, the heat dissipated within a unit area is not obvious, so that the temperature of the air flow brought away by the high-speed air flow will not significantly increase, which will not affect the use effect. This is a feasible solution proved by practice.

The shell includes a front shell 3 and a rear shell 7 which are mutually covered and connected; after the front shell 3 and the rear shell 7 are covered and connected, the air duct 72 is formed at an upper end, and a second accommodating chamber is formed at a lower end; the circuit board assembly 5 and a battery 6 are arranged in the second accommodating chamber; the circuit board assembly 5 and the battery 6 are electrically connected; an air inlet cover 8 covers the air inlet of the air duct 72; and a hang hole 73 is provided at a corner of a lower end of the shell. The hang hole 73 is configured to tie a sling, thereby adding scenarios to carry the fan. The circuit board assembly 5 is electrically connected with the control button and a USB interface; and the control button and the USB interface are both arranged in through holes preset in the shell and extend out from the through holes. The control button is configured to adjust and switch a working mode and an on/off state of the fan. The USB is connected to an external power supply by using a charging cable, so that the storage battery 6 can be charged to supplement the electric energy of the storage battery 6.

In summary: According to the present disclosure, the boosting mechanism achieves boosting and speeding up on an air flow for the first time; the rectification mechanism dredges a high-speed air flow to intensively blow out the air flow in a direction parallel to the axis of the necking hood 31 as much as possible, so that the air flow utilization rate is increased, and secondary boosting and speeding up are achieved, which greatly improves the air speed and the air supply distance; furthermore, in an air flow stroke, by controlling the details, such as the first air-cutting edge 323 and the second air-cutting edge 712 being set as the acute edges and the rectification blades 32 cooperating with the necking hood 31, the turbulence is eliminated step by step, so that the turbulence is eliminated at the source, to achieve an effect of silently blowing air at a high speed.

It should be noted that in this document, relationship terms such as first and second are used solely to distinguish one entity or operation from another entity or operation without necessarily requiring or implying any actual such relationship or order between such entities or operations. Furthermore, the terms "include", "including", or any other variation thereof, are intended to encompass a non-exclusive inclusion, such that a process, method, article, or device that includes a list of elements does not include only those elements but may include other elements not explicitly listed or inherent to such process, method, article, or device.

Although the embodiments of the present disclosure have been shown and described, it can be understood by those of ordinary skill in the art that various changes, modifications, substitutions, and variations can be made to these embodiments without departing from the principle and spirit of the present disclosure. The scope of the present disclosure is defined by the accompanying claims and their equivalents.

What is claimed is:

1. A silent high-speed fan, comprising a shell, wherein an air duct (72) is formed on the shell;

an air inlet and an air outlet are respectively provided at two ends of the air duct (72);

a boosting mechanism (4 and 71) is arranged in the air duct (72); the boosting mechanism drives air located at the air inlet to flow through the air duct (72) and then be blown out from the air outlet at a high speed;

a rectification mechanism is arranged at the air outlet; the rectification mechanism includes a necking hood (31) that covers the air outlet and a rectification blade group composed of a plurality of rectification blades (32) arranged coaxially on an inner side of the necking hood (31) in an annular array;

two ends of the necking hood (31) are both provided with openings;

an inner diameter of the necking hood (31) decreases radially from one end facing the air duct (72) to one end away from the air duct (72);

the rectification blades (32) comprise air outlet rectification plates (321) and wind concentration rectification plates (322);

the air outlet rectification plates (321) are arranged on one side close to the air duct (72);

the wind concentration rectification plates (322) are connected to one ends of the air outlet rectification plates (321) proximate to an inner wall of the necking hood (31) and extend towards one side edge of the necking hood (31) away from the air duct (72);

side edges of the wind concentration rectification plates (322) proximate to an inner wall surface of the necking hood (31) are connected to the inner wall surface of the necking hood (31); and the air outlet rectification plates (321) and the wind concentration rectification plates (322) are both parallel to a central axis of the necking hood (31).

2. The silent high-speed fan according to claim 1, wherein a width h of each air outlet rectification plate (321) is not less than 3 mm.

3. The silent high-speed fan according to claim 1, wherein one side edge of each air outlet rectification plate (321) facing the boosting mechanism is a first air-cutting edge (323), and the first air-cutting edge (323) is an acute edge.

4. The silent high-speed fan according to claim 1, wherein a first accommodating chamber (33) is connected to the middle of the rectification blade group; a digital display screen assembly (2) is mounted inside the first accommodating chamber (33); and a transparent cover (1) is arranged on an outer side of the digital display screen assembly (2) in a covering manner.

5. The silent high-speed fan according to claim 1, wherein a first accommodating chamber (33) is connected to the middle of the rectification blade group; a cold and hot semiconductor chip (21) is mounted in the first accommodating chamber (33); a conduction cover (11) covers one side of the first accommodating chamber (33) away from the boosting mechanism; a through hole is provided on one side of the first accommodating chamber (33) close to the boosting mechanism; a heat dissipation assembly (22) is arranged on one side of the through hole facing the boosting mechanism; a cooling end of the cold and hot semiconductor chip (21) is connected to the conduction cover (11) in a thermal conduction manner; and a heating end of the cold and hot semiconductor chip (21) is connected to the heat dissipation assembly (22) in a thermal conduction manner.

6. The silent high-speed fan according to claim 1, wherein the boosting mechanism comprises an air-driving blade assembly (4) and an air-cutting blade group composed of a plurality of air-cutting blades (71) arranged coaxially on one side of the air-driving blade assembly (4) facing the rectification mechanism in an annular array; the air-driving blade assembly (4) comprises a plurality of air-driving blades (41) arranged around a circumferential direction of the air-driving blade assembly (4); surfaces of the air-cutting blades (71) facing an outer side of the air outlet is a windward surface (711); surfaces of sides of the air-driving blades (41) facing the air-cutting blades (71) are air-driving surfaces (411); in a rotating process of the air-driving blade assembly, in a same radial region, a curved surface where the windward surfaces (711) are located and a curved surface where the air-driving surfaces (411) are located are intersected; and an angle between the windward surfaces (711) and the air-driving surfaces (411) is $\theta 1<90°$.

7. The silent high-speed fan according to claim 6, wherein an angle $\theta 2$ between each windward surface (711) and a central axis of the air-driving blade assembly (4) satisfies: $30°<\theta 2<60°$.

8. The silent high-speed fan according to claim 6, wherein one side edge of each air-cutting blade (71) facing the air-driving blade assembly (4) is a second air-cutting edge (712), and the second air-cutting edge (712) is an acute edge.

9. The silent high-speed fan according to claim 1, wherein the shell comprises a front shell (3) and a rear shell (7) which are mutually covered and connected; after the front shell (3) and the rear shell (7) are covered and connected, the air duct (72) is formed at an upper end, and a second accommodating chamber is formed at a lower end; a circuit board assembly (5) and a battery (6) are arranged in the second accommodating chamber; the circuit board assembly (5) and the battery (6) are electrically connected; an air inlet cover (8) covers the air inlet of the air duct (72); the circuit board assembly (5) is electrically connected with a control button and a USB interface; and the control button and the USB interface are both arranged in through holes preset in the shell and extend out from the through holes.

10. The silent high-speed fan according to claim 9, wherein a hang hole (73) is provided at a corner of a lower end of the shell.

* * * * *